United States Patent [19]

Matikainen

[11] 4,271,574

[45] Jun. 9, 1981

[54] MECHANICAL DRIVE FOR ROTATABLE MANTLE ROLL MOUNTED ONTO A STATIONARY AXLE, ESPECIALLY FOR A DEFLECTION-COMPENSATED ROLL MANTLE OF A PAPER MACHINE

[75] Inventor: Martti Matikainen, Ulvila, Finland

[73] Assignee: Hunt & Moscrop (Paper Machinery) Ltd., Middleton, England

[21] Appl. No.: 33,958

[22] Filed: Apr. 27, 1979

[30] Foreign Application Priority Data

Apr. 27, 1978 [FI] Finland ..... 781325

[51] Int. Cl.[3] ..... B60B 15/16; F16H 57/00; F16H 1/28

[52] U.S. Cl. ..... 29/115; 74/410; 74/801

[58] Field of Search ..... 29/115, 116 R, 116 AD; 74/410, 801

[56] References Cited

U.S. PATENT DOCUMENTS

| | | | |
|---|---|---|---|
| 3,290,897 | 12/1966 | Kuehn | 29/115 X |
| 3,419,890 | 12/1968 | Justus | 29/115 |
| 3,562,882 | 2/1971 | Widmer et al. | 29/115 |
| 3,678,775 | 7/1972 | Danielsson | 74/410 |
| 3,766,620 | 10/1973 | Roerig | 29/115 |
| 4,062,252 | 12/1977 | Matikainen | 74/410 X |

FOREIGN PATENT DOCUMENTS

| | | | |
|---|---|---|---|
| 50-30586 | 10/1975 | Japan | 29/115 |

*Primary Examiner*—James Kee Chi

*Attorney, Agent, or Firm*—Burns, Doane, Swecker & Mathis

[57] ABSTRACT

The invention relates to a drive for a rotatable mantle roll mounted onto a stationary axle. The mantle is driven by one or more driving gears which are again driven by one or more shafts journalled in a supporting frame located around the stationary axle end. The driving gear or gears drive an internally toothed gear ring connected to the roll mantle. The improvement lies in that the supporting frame which is supported by rolling or sliding elements is placed inside a shell connected to the mantle or inside the mantle as a stationary unit with its different elements. The supporting frame is coupled by special elements not to rotate so that the said location with the mantle is possible.

16 Claims, 7 Drawing Figures

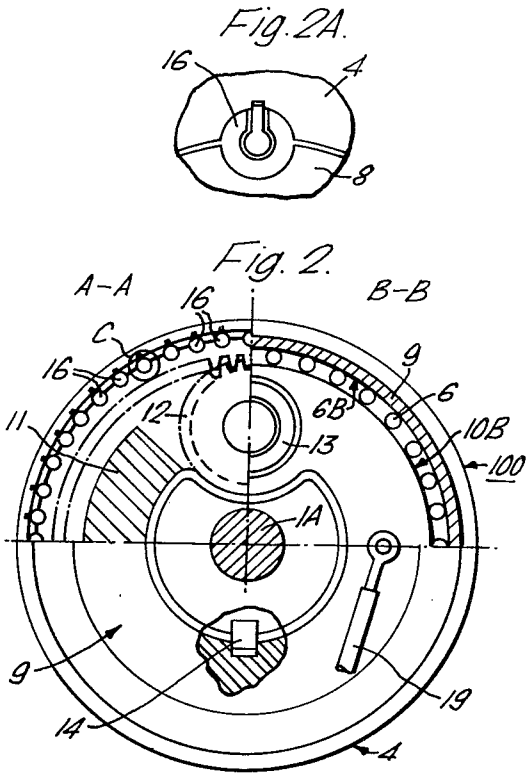
Fig. 2A.
Fig. 2.
B-B
A-A
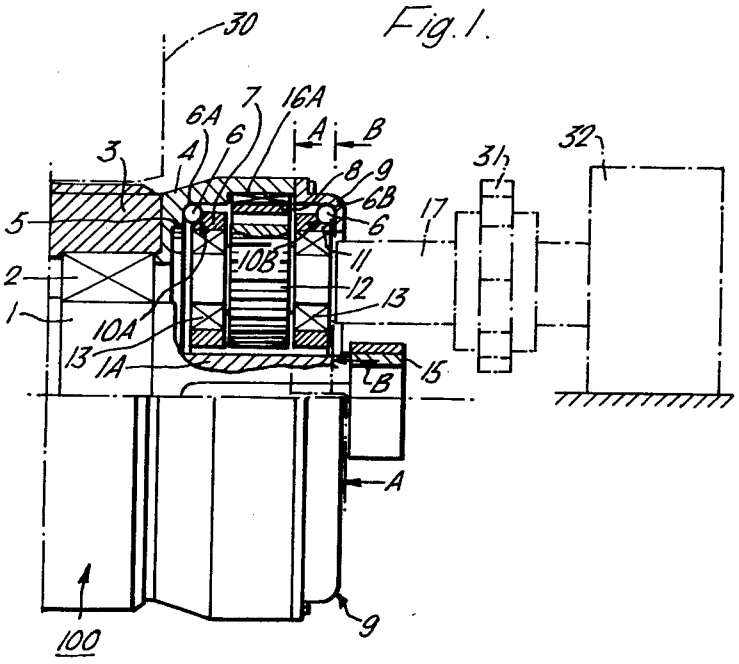
Fig. 1.

12A
22
23A
21
I
I
24
20
10B
17A
6B
9
6
C
E
9
H
G
F
11
D
8
4
30
6
6A
7
10A
12A
4
100
3
2
2

100
I-I
12B
22
23B
17B
20
24
1A
16
4
12A
17A
C-H
6
4
16
6

MECHANICAL DRIVE FOR ROTATABLE MANTLE ROLL MOUNTED ONTO A STATIONARY AXLE, ESPECIALLY FOR A DEFLECTION-COMPENSATED ROLL MANTLE OF A PAPER MACHINE

The subject of the present invention is a mechanical drive for a rotatable mantle roll mounted onto a stationary axle, especially for a deflection-compensated roll mantle of a paper machine, which drive comprises one or several driving gears driven by an axle or by several axles and journalled on a supporting frame surrounding the end of the stationary axle, said driving gear/gears driving an internally toothed gear ring which is connected to the rotatable mantle roll.

As regards the standard of technology, to begin with, reference is made to the U.S. Pat. Nos. 4,062,252 and 4,111,065.

Several different drives that perform the duty defined above are known previously. A known triple-ring journalled drive comprises two ball-type roller bearings, the rotating power of the mantle roll being passed by means of a ring placed between said bearings and by means of rigid joints from the drive shaft to the outer mantle of the roll. Any changes in angles between the roll axle and the mantle roll are compensated at the spherical bearing faces. It is a drawback of this known drive that its radial requirement of space does not permit the use of a sufficiently large triple-ring bearing, but it is necessary to use an underdimensioned bearing, which results in short service life of the bearing.

Another known triple-ring journalled gear is constructed as provided with one cylindrical and one spherical roller bearing, the rotating power of the mantle roll being passed by means of a dual gear coupling and by means of a ring placed between said bearings from the shaft of the drive end to the outer mantle of the roll. Owing to curved tooth ends, said dual gear coupling permits a small change in the angle between the centre axle of the roller and the bearing housing. This drive involves the same drawback as the first-mentioned drive.

As regards the standard of technology, reference is further made to the drive known from the U.S. Pat. No. 3,855,681 (USM Corporation, U.S.A.), wherein the primary novelty lies therein that two drive wheels have been mounted on at least one of the two side shafts placed parallel to the drive shaft, out of which drive wheels one is in toothing engagement with the driving gear of the drive shaft and the other one with an externally toothed gear ring and that, as the drive shaft is mounted stationarily, the side shaft is positioned in such a way diagonally to the direction of the shaft of the flange that, with a predetermined radial load of the mantle roll, the direction of the shaft of the side axle and the direction of the flange shaft become parallel.

In the above U.S. Patent, three alternative embodiments of the drive are suggested, in the first one of which the power is transmitted only along one route from the drive shaft to the outer mantle of the roll. This embodiment is based on single-joint journalling, which means uneven running if the mantle is shifted in relation to the drive. Moreover, the reception of forces by the cogwheel driving the roll mantle (component 50) at mesh is defective, because the toothing is always pressed to one side. Since the entire drive mechanism is placed outside the roll, the requirement of space of the drive mechanism is large.

In the second embodiment of the above U.S. Patent, the power passes along two routes from the drive shaft to the outer mantle of the roll. The construction concerned is based on dual-joint support, and therein the load has been made symmetrical. It is a drawback that even distribution of the load among the two routes of power transmission is not assured if the lack of precision in the manufacture of the components is taken into account.

In the third embodiment of the above U.S. Patent, the power passes along three routes from the drive end shaft to the outer mantle of the roll. This embodiment is also based on dual-joint support, and the support of the cogwheel (part 50) driving the mantle of the roll is defective, which is the case in the two former embodiments as well. Moreover, even distribution of the load among the three routes of power transmission is not assured if the lack of precision in the manufacture of the components is taken into account. Also, it can be mentioned as a drawback that the diagonal position of the side axle is only dimensioned in view of a certain line pressure between the rolls, which restricts the possibilities of variation of the line pressure load.

Generally speaking, the invention relates to improvements in driven roll mantle drives journalled on a stationary axle. The roll generally consists of a stationary axle which is supported into a bearing housing by a ball joint. When operating as the drive roll of a press, calender, roller, etc., the roll tends to deflect under external load. The load also deflects the stationary axle. The deflection of the roll mantle may be eliminated by different technical solutions. In the shaft the load brings forth tilting and transition in relation to the mantle. These changes in direction and distance between the mantle and the shaft, dependent on load, are problems encountered when mantle transmission drives are constructed.

It is an objective of the present invention to provide a drive with little space requirement, low running noise, and running free of vibration.

For the purpose of achieving the above goals, and those to come out later, the invention is mainly characterized in that said supporting frame, supported by rolling and/or sliding elements, is placed inside a shell which is stationarily connected to a rotatable mantle roll and/or inside a rotatable mantle to locate with the mantle as a stationary unit with its different elements and that said supporting frame is coupled by special elements so as not to rotate so that the above location with the mantle should be possible.

The drive in accordance with the present invention is most appropriately accomplished so that the drive is composed of a transmission with an internal gear wheel, loose from a shaft, from its supporting bearing, and from the bearing housing, at which drive the ring-like shell of the transmission is stationarily connected to a rotating roll mantle and the driven, internally toothed gear wheel of the transmission is coupled to the ring-like shell and is supported by it, and the driving gears are journalled on the supporting frame surrounding the shaft, which is further journalled on the ring-like shell. The locking of the supporting frame in order to prevent rotation is, according to a preferred embodiment of the invention, arranged by a loose key into the shaft or by a separate pulling bar into an external support, or by any other comparable arrangements.

The drive in accordance with the present invention is completely following the movements of the mantle and is independent from the relative position of the stationary axle of the roll in relation to the mantle. Furthermore, the invention makes it possible to avoid big gear couplings, which are typical of most previously known corresponding drives and which, by means of their unbalanced running, cause vibrations and noise when the drive power is transferred to the shaft, or to the roll mantle from drive elements supported to the pedestal support.

In one advantageous embodiment of the invention, the driven ring gear is fixed to the shell, consituting an extension of the roll mantle, by means of dampening spring rings in themselves known, for in modern high-speed press and print rolls it is decisively important to eliminate and dampen any vibrations coming through the drives.

In another advantageous embodiment of the invention, the driving motor is connected by means of an elastic coupling to the driving shaft of the drive or, if necessary, a preceding gear is connected to the shaft, which preceding gear is preferably mounted stationarily to the drive gear and is thereby located in accordance with the driven mantle. This solution is appropriate in particular when relatively high powers must be transmitted and when more than one are used.

Below, further advantages that can be achieved by means of the invention are stated: The space requirement of the drive is reduced, being mostly less than the outer diameter of the roll mantle, and therefore it is possible to place several rolls with adjustable deflection close to each other in the press constructions of of paper machines. Moreover, owing to the small size of the drive, there are no difficulties, which used to be common previously, in fastening scrapers etc. similar auxiliary equipment to the roll. It should also be mentioned as an advantage provided by the present invention, as compared with certain known solutions, that by means of the drive gear it is possible to cover an extensive range of transmission ratios and powers by using one or more driving shafts and, if necessary, a preceding gear, while the principal idea of the invention remains the same.

The drive in accordance with the present invention is also easy to install and to service; also, in the case of old rolls which are provided, e.g., with the known three-ring bearing drive it is possible to install the drive in accordance with the invention at relatively low costs, because the need of machining at the end of the roll and in the axle is little and the machining does not make the supporting units substantially weaker, which is the case with certain known similar solutions.

Below, the invention will be described in detail with reference to the exemplifying embodiments illustrated by the figures in the drawing, whereby the invention is, however, not specifically restricted to their details.

FIG. 1 shows the drive as viewed from above, the upper part of the figure being in axial section.

FIG. 2 shows the drive in accordance with FIG. 1 as viewed from the end of the roll. The upper left quarter of FIG. 2 shows the drive as a section along line A—A in FIG. 1, the upper right quarter as a section along line B—B in FIG. 1.

FIG. 2A shows a detail C, i.e. the elastic coupling between the internally toothed ring gear and the shell.

Figure 3:
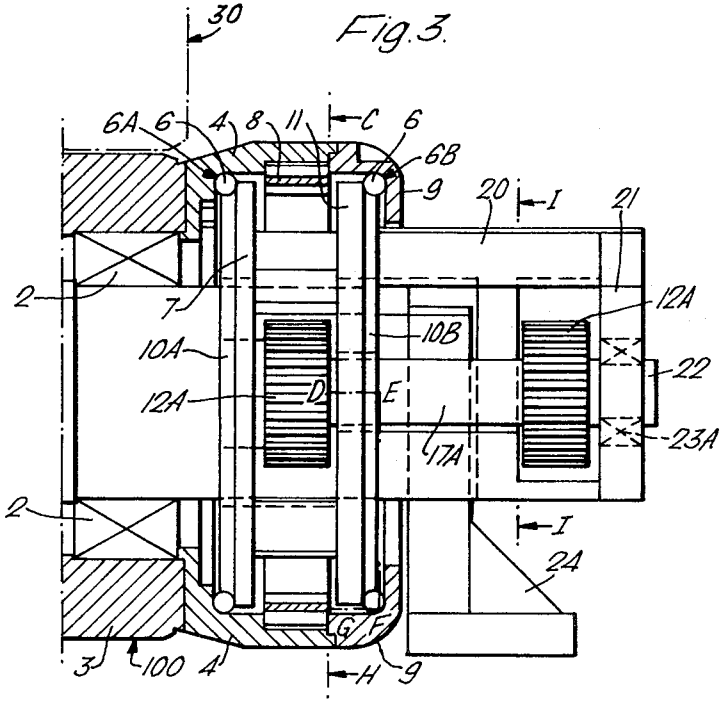
FIG. 3 is a side view in axial section of such an embodiment of the invention in which a preceding gear is used whose input shaft drives two parallel gear shafts.
Figure 4:
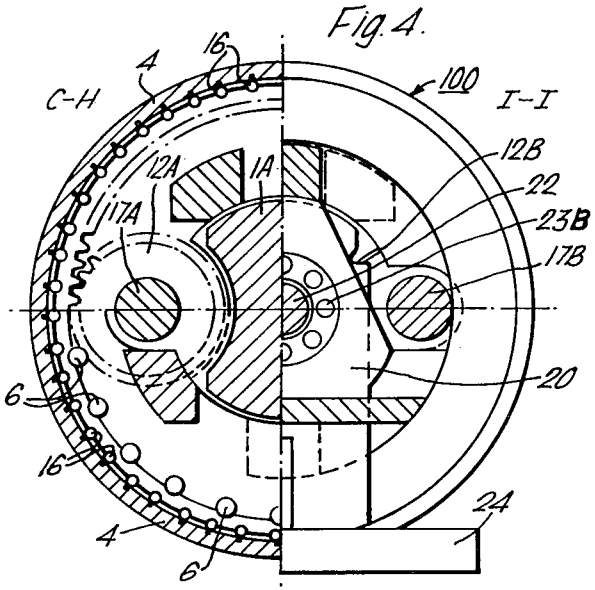

The left side of FIG. 4 shows section C-H in FIG. 3 and, correspondingly, the right side of FIG. 4 shows a section along line I—I in FIG. 3.

Figure 5:
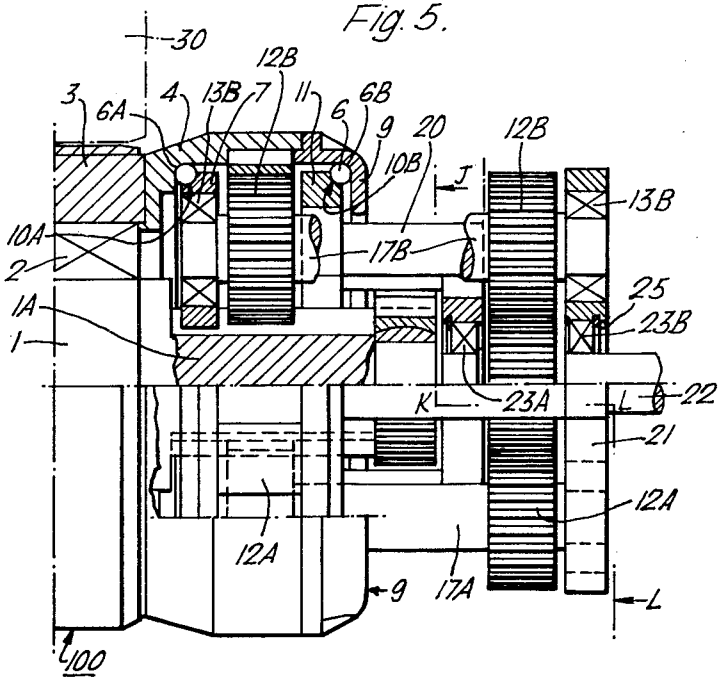
Figure 6:
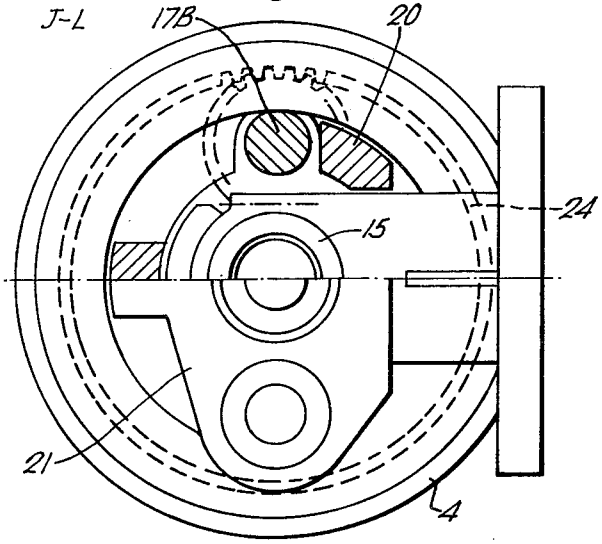

FIG. 5 shows the drive in accordance with FIGS. 3 and 4 as a horizontal section, i.e. as viewed from above, and the upper half of FIG. 6 shows a section J-L in FIG. 5 and the lower half of FIG. 6 shows the drive as viewed from the end.

As shown in FIGS. 1 to 6, the rotating mantle roll 100, journalled on a stationary axle, is composed of the stationary axle 1, on which the driven mantle roll 3 is fitted by means of bearings 2. If a roll with adjustable deflection is concerned, it is possible, by means of particular adjusting means, to achieve a line pressure of desired form, usually even, between the roll 100 mantle 3 and the counter-roll 30, which is shown schematically by broken lines. Both ends of the stationary axle 1 are supported by means of a ball joint bearing 15 on the pedestal 24 (not shown in FIGS. 1 and 2), which is fastened to the frame of the paper machine.

When the roll 100 is loaded, the axle 1 is deflected and its ends 1A are tilted with the inner ring of the bearing 15.

As shown in FIGS. 1 to 6, an annular shell 4 is rigidly fastened to one end of the roll 100 mantle 3 by bolts 5. Glide or roller bearing means are arranged into the shell 4, in the figures balls 6 and bearing lines 6A and 6B, as well as tracks 16A for spring-like bushings 16, by means of which the internally toothed driven gear ring 8 is elastically fastened to the shell 4. Axial locking of the gear ring is made by ring-like part 9, into which the bearing means mentioned above have been placed. The supporting frame is composed of two halves 7 and 11, which are joined together permanently by means of bolts.

As shown in FIGS. 1 and 2, driving gear 12, with bearings 13 at both ends, is journalled on the supporting frame. Bearing means, denoted in the figures by reference numerals 10A and 10B, respectively, are placed into both halves of the supporting frame. Referring to FIGS. 1 and 2, a shaft 17, constituting an extension of gear 12, is coupled by elastic coupling 31 to a motor 32, which is shown schematically.

The supporting frame 7, 11 is supported and precisely guided by rolling elements 6 by means of rolling lines 10A, 10B in the shell 4 and in accordance with rolling lines 6A, 6B in the ring 9. As shown in FIGS. 1 and 2, the gear 12 driven by the motor 32 takes a position in accordance with the supporting frame 7, 11 and the rolling elements 6, which position is independent from the load and movement of the roll 100.

The locking of the supporting frame 7, 11 against rotation is accomplished either by means of a key 14 in the axle 1, with a loose fit to the key way in the supporting frame 7, or by means of a pulling bar 19, whose one end is fixed to the supporting frame and the other end, e.g., to the machine frame. The key 14 or the bar 19 allow the drive to move freely along with the mantle 3 of the roll 100, preventing rotation, independently from the axle 1.

In FIGS. 3, 4, 5, and 6, a drive in accordance with the invention is shown as provided with a preceding gear. The gear wheel 8 with internal toothing is driven by two (even more if necessary) gears 12A, 12B. At one end, the driving gears 12A, 12B are journalled on the half 7 of the supporting frame, at the other end on the end cover 21. The supporting frame, journalled on the shell 4, is composed of part 7, provided with a rolling line 10A or with any other bearing face, and of part 11, also provided with a rolling line 10B or with any other bearing face. The part 7 is fastened by means of screw joints to the interplate 11 of the supporting frame, to which the middle part 20 of the supporting frame is also fastened, said middle part being drawn as three-armed in FIGS. 3 to 6. The gable 21 is fastened to the middle part 20. The driving shaft 22 is fitted in the middle part and in the gable with bearings 23A and 23B. The driving power is brought onto the shaft 22 from the motor (not shown) by means of elastic joints in themselves known. As shown in FIGS. 3 to 6, the locking of the transmission into the machine frame is made as mentioned in respect of the alternative with no preceding gear, shown in FIGS. 1 and 2. The preceding gear as a whole may be covered by a box (not shown), which may again be supported onto the pedestal 24. Between the part 9 and the box, there shall be a seal in order to prevent oil leakage. The preceding gear may also be used in embodiments provided with one side shaft.

Some of the important characteristic features of the drive described in the invention are that the drive parts are supported into the roll mantle 3, and not into the deflective stationary axle or to the bearing housing of the roll. The changes in the position of the roll mantle remain relatively little especially when a deflection-compensated roll is concerned. It is another important feature of the invention that the equipment includes no unbalanced separate parts, such as gear couplings, bringing forth running noise and vibration. As shown in FIGS. 1 and 2, the power is brought by means of one side shaft from the motor 32 by the intermediate of an elastic joint 31. Such a construction is particularly advantageous when relatively little powers are transferred. As shown in FIGS. 3 to 6, two side shafts 17A and 17B with bearing 13A (not illustrated) and 13B have been used as connected by means of a preceding gear which divides the power coming from the driving motor to the side shafts. If necessary, it is also possible to use more side shafts than two. An embodiment of the invention provided with a preceding gear and several side shafts is advantageous especially when higher powers are transmitted, and, moreover, by using a preceding gear it is possible to control the transmission ratios within sufficiently wide limits.

In embodiments in which only one side shaft connected to the driving gear 12 is used or in embodiments in which there are several side shafts but these are not located symmetrically in relation to the centre of the gear ring 8, the glide faces or rolling lines 6A, 6B of the shell 4 and ring 9 function as support bearings receiving forces.

The invention is by no means strictly restricted to the details described above only by way of example, which details may show variation within the scope of the inventional idea to be defined below in the patent claims.

What I claim is:

1. A mechanical drive for a rotatable mantle roll mounted on a stationary axle, said axle having an axle end region, said mechanical drive comprising:

a supporting frame, said supporting frame surrounding said axle end region;

at least one shaft;

at least one driving gear driven by said shaft and journalled to said supporting frame;

an internally toothed gear ring, said gear ring being connected to said rotatable mantle roll and being driven by said at least one driving gear;

a shell member stationarily connected to said rotatable mantle roll;

bearing means mounted inside said shell member for supporting said supporting frame; and locking means for locking said supporting frame with respect to said stationary axle;

wherein said at least one driving gear and said internally toothed gear ring are guided independently of said stationary axle.

2. The mechanical drive of claim 1 wherein said shell member is at least partially located inside said rotatable mantle roll.

3. The mechanical drive of claim 1 wherein said bearing means comprises a roller bearing.

4. The mechanical drive of claim 1 wherein said bearing means comprises a glide bearing.

5. The mechanical drive of claim 1 further comprising a ring member, said ring member being included at an end of said shell member and said ring member cooperating with said shell member in order to axially position said internally toothed gear ring.

6. The mechanical drive of claim 5 wherein said bearing means includes bearing faces and further wherein said bearing faces cooperate with said shell member and said ring member in order to guide, support and centralize said at least one driving gear in said supporting frame.

7. The mechanical drive of claim 1 wherein said supporting frame, said at least one driving gear, said internally toothed gear ring and said shell member are located at least partially inside said rotating mantle roll.

8. The mechanical drive of claim 1 wherein said stationary axle is supported by a support bearing member, and wherein said at least one driving gear and said internally toothed gear ring are guided independently of said support bearing member.

9. The mechanical drive of claim 1 wherein said at least one shaft, said at least one driving gear and said internally toothed gear ring are supported substantially centrally with respect to the axis of rotation of said rotatable mantle roll in order to reduce vibrations due to eccentricities.

10. The mechanical drive of claim 1 further comprising:

a drive shaft adapted to receive mechanical power;

a preceding gear, said preceding gear being driven by said drive shaft;

wherein said supporting frame includes a supporting frame member and a middle member connected to said supporting frame member, said preceding gear being housed by said middle member;

wherein said at least one shaft includes a first side shaft and a second side shaft;

wherein said at least one driving gear includes first, second, third, and fourth driving gears, said first and second driving gears being mounted on said first side shaft and said third and fourth driving gears being mounted on said second side shaft such that said second and fourth driving gears are engaged by said preceding gear, said preceding gear distributing the power received from said drive shaft to said second and fourth driving gears in order that said first driving gear is driven by said first side shaft and said third driving gear is driven by said second side shaft.

11. The mechanical drive of claim 10 wherein said toothed gear ring is located inside said rotatable mantle roll.

12. The mechanical drive of claim 10 wherein said toothed gear ring is located inside said shell member.

13. The mechanical drive of claim 1 further comprising fastening means for elastically connecting said internally toothed gear ring to the inside of said rotatable mantle roll.

14. The mechanical drive of claim 1 further comprising fastening means for elastically connecting said internally toothed gear ring to the inside of said shell member.

15. The mechanical drive of claims 13 or 14 wherein said fastening means comprises spring members.

16. The mechanical drive of claim 15 wherein said internally toothed gear ring has a first axis, said at least one shaft being asymetrically disposed with respect to said first axis, and further wherein said bearing means includes bearing faces, said bearing faces cooperating with said shell member and said ring member to guide and support said at least one driving gear in said supporting frame.

* * * * *